United States Patent [19]

Mierbach et al.

[11] Patent Number: 4,765,210

[45] Date of Patent: Aug. 23, 1988

[54] HYDRAULICALLY POWERED SCREWING MEANS

[75] Inventors: Hans-Bernd Mierbach; Gustav Frohn, both of Konigswinter; Olaf Blockisch, Hennef, all of Fed. Rep. of Germany

[73] Assignee: Applied Power, Inc.

[21] Appl. No.: 744,325

[22] Filed: Jun. 13, 1985

[30] Foreign Application Priority Data

Jun. 1, 1984 [DE] Fed. Rep. of Germany ..... 3420446

[51] Int. Cl.[4] ..... B25B 13/46

[52] U.S. Cl. ..... 81/57.39; 81/58.2

[58] Field of Search ..... 81/57.39, 58.2

[56] References Cited

U.S. PATENT DOCUMENTS

| | | | |
|---|---|---|---|
| 2,636,411 | 4/1953 | Wood | 81/58.2 |
| 2,660,910 | 12/1953 | Sellers | 81/58.2 |
| 4,339,968 | 7/1982 | Krieger | 81/57.39 |
| 4,368,655 | 1/1983 | Junkers | 81/57.39 |
| 4,440,046 | 4/1984 | Hirtsiefer et al. | 81/57.39 |

*Primary Examiner*—Frederick R. Schmidt
*Assistant Examiner*—Maurina Rachuba
*Attorney, Agent, or Firm*—John J. Byrne; Bradford E. Kile

[57] ABSTRACT

The nut-runner has a power arm and a reaction arm constructed preferably as a casing, each of which is guided in a first end region so as to be pivotable opposite the other about a common axis. It has a clamp wheel with gearing mounted in a drilled hole in the first end region of the power arm so as to be rotatable about the axis, and a catch mounted on the power arm and interacting with this clamp wheel, said catch being in the engaged position when the power arm pivots in one direction, in which said catch engages with the teeth of the clamp wheel and slips over the teeth of the clamp wheel when the power arm pivots in the other direction. The nut-runner also has a hydraulic power cylinder consisting of a cylinder and a piston and acting between the two arms in the vicinity of their other end regions. The reaction arm encompasses the clamp wheel through a maximum of 180 degrees. The arm engage each other by way of a circular guide positioned concentrically relative to the axis, extending through a maximum of 180 degrees, and consisting of a guide groove and a projection, said guide being positioned between the axis and the second end region of the arms.

7 Claims, 3 Drawing Sheets

HYDRAULICALLY POWERED SCREWING MEANS

BACKGROUND OF THE INVENTION

The invention relates to a nut-runner with a power arm and a reaction arm constructed preferably as a casing, each of which is controlled in one end region so as to be pivotable relative to each other about a common axis, with a geared clamp wheel which is mounted in a drilled hole in the first end region of the power arm so as to be rotatable about the axis, and with a catch mounted on the power arm interacting with this clamp wheel, said catch being in the engaged position when the power arm pivots in one direction, in which position said latch engages with the teeth of the clamp wheel, and slips over the teeth of the clamp wheel when the power arm pivots in the other direction, and with a hydraulic power cylinder consisting of a cylinder and a piston which acts between the two arms in the vicinity of their other end regions.

In this nut-runner, previously known from DE-OS No. 30 08 381, the clamp wheel, the power arm encompassing the clamp wheel, and the reaction arm, which completely encompasses the power arm, are positioned concentrically from the interior outward. For this purpose the reaction arm, also constructed as a casing, has in its first end region an opening which runs concentrically relative to the axis and in which the circular first end region of the power arm is led to the exterior. Because of these three elements, positioned concentrically and as sleeves, the distance between the internal opening of the clamp wheel and the exterior of the reaction arm in the area of the first end region of the latter is rather large. In other words, a relatively great amount of clearance is required around a nut or screw on which the hexagonal recess of the clamp arm is mounted for it to be possible to mount the nut-runner referred to in the foregoing. Nut-runners such as those referred to above are typically used for bracing flanges. The clearance around a tensioning nut or screw of such a flange connection is determined in part by the distance to the next screw or nut, but this clearance typically is even greater than the space remaining free radially inward. In the case of a flange connection of pipes, for example, the effort has been made to reduce to the minimum the distance between the tensioning screws and the outer wall of the pipes to be connected, and the radial clearance is correspondingly small.

The untoleranced dimension of the state-of-the-art nut-runner described in DE-OS No. 30 08 381 is determined by the external diameter of the first end region of the reaction arm. This untoleranced dimension is always the same, regardless of the clamp wheels employed. In the case of the state-of-the-art nut-runner, the untoleranced dimension is still justifiable when the clamp wheel with the largest hexagonal recess is used, but becomes disadvantageously large when the clamp wheel with the smallest hexagonal recess is used. To remedy the situation, a special nut-runner would have to be produced, at least for all current widths across hexagonal nuts. This, however, would entail heavy expense for manufacture, storage, and use. Consequently, nut-runners are normally manufactured for a certain range of nominal widths across within which the clamp wheels required may be used. But in this case the goal of keeping the untoleranced dimension about as large for all widths across flats as it is in the case of eyebolt wrenches cannot be reached.

It is consequently the aim of the invention to avoid the disadvantages of the state-of-the-art nut-runner described in DE-OS No. 30 08 381 and to improve the nut-runners of the type discussed in the foregoing by making the untoleranced dimension smaller, and in particular by causing it to fall within the range of that of a conventional eyebolt wrench.

This problem is solved on the basis of the nut-runners of the type previously discussed, in that the reaction arm encompasses the clamp wheel through a maximum of 180 degrees and the arms engage by way of a circular guide positioned concentrically relative to the axis, extending over a maximum of 180 degrees, and consisting of a guide groove and a projection, this guide being positioned between the axis and the second end region of the arms.

The decisive difference relative to the state-of-the-art nut-runner described in DE-OS No. 30 08 381 lies in the circumstance that the power arm is no longer mounted in a circular opening in the reaction arm, and thus the guide between power arm and reaction arm does not extend through 360 degrees; this guide is rather positioned between the axis and the second end regions of the arms and extends through a maximum of 180 degrees. As a result, the reaction arm no longer encompasses the power arm (as with the state-of-the-art nut-runner); it rather ends above a line running transversely to the longitudinal direction of the reaction arm and through the axis. The untoleranced dimension of the nut-runner as thus described, especially the radial untoleranced dimension, is thus no longer determined by the external dimensions of the reaction arm, being determined exclusively by the circular free end of the power arm.

In a preferred further development of the invention it is now proposed that the power arm be detachably connected to the reaction arm, so that the power arm can be simply replaced. In contrast to previously known nut-runners, the clamp wheel is no longer replaced in order to change the width across the flat; the unit is removed from the clamp wheel and power arm instead. This has the decided advantage that, regardless of the size of the reaction arm (which is constructed preferably as a casing), the untoleranced dimension on the free end of the power arm is always the smallest possible dimension relative to a specific width across a flat. In other words, the untoleranced dimension is determined essentially by the size of the clamp wheel, on the basis of replacement of the power arm. The overall advantage is achieved that a single casing of a nut-runner, in which it is also advisable to house the power cylinder, can be outfitted for different widths across and the smallest possible untoleranced dimension per width across is achieved.

The embodiment of the nut-runner claimed for the invention can be achieved with a nut-runner as described in DE-OS No. 30 08 381, the power cylinder in this case being mounted preferably in the reaction arm, to permit designing the component made up of power arm and clamp wheel, inclusive of the catch, as simply as possible. In an especially preferred further development, a nut-runner as described in DE-OS No. 34 07 126 is used, in which a more or less pear-shaped power arm is provided the smaller drive coupling of which is located inside the cylinder bore and catches in a recess in the piston, the axial line of the cylinder bore running transversely to the longitudinal direction of the power cylinder. In the case of this nut-runner the reaction arm is designed as a casing and consists preferably of a casing component and of bearing boxes that can be fastened to the side of this casing component by simple means, in which bearing boxes the guide for the power arm is formed. To replace a power arm it is necessary only to remove these bearing boxes, after which the power arm may be extracted from the casing component. As a result, power arm replacement is rendered especially simple.

Other advantages and characteristics of the invention are to be seen from the remaining claims and from the following description of an embodiment, to be understood as being non-restrictive, which is presented with reference to the drawing, in which

THE DRAWINGS

FIG. 1 shows a section through a nut-runner corresponding to profile line I—I in FIG. 2, FIG. 2 shows a sectional view corresponding to profile line II—II in FIG. 1, and FIG. 3 shows a top view of a bearing box.

DETAILED DESCRIPTION

Figure 1:
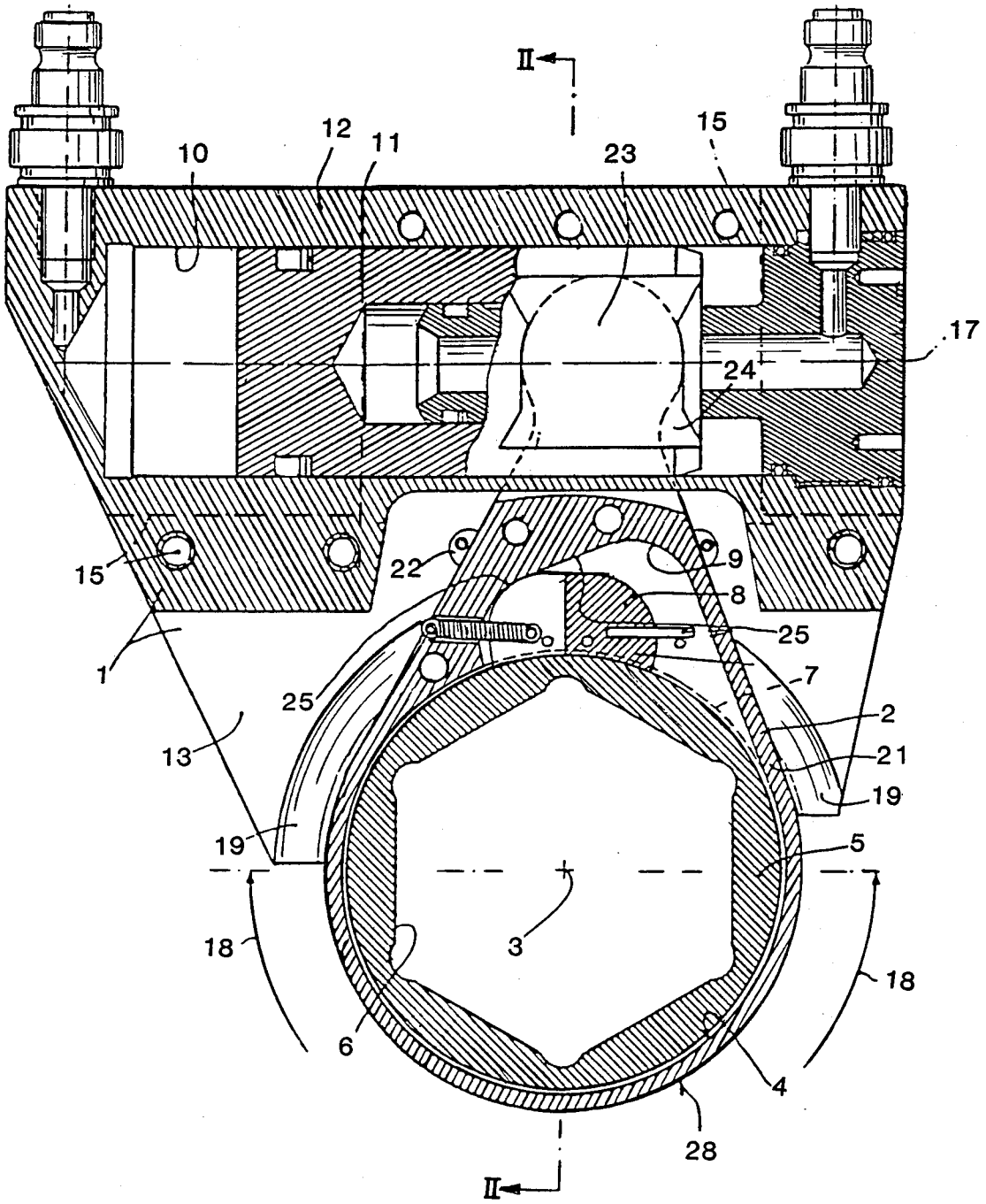

The nut-runner shown in the figures has a reaction arm 1 designed as a casing and a power arm 2, which power arm is guided to rotate in reaction to arm 1 both of which are mounted about a common axis in their first end region, which is the lower end region in the figures. The power arm 2 has a circular bore 4 in its first, or lower, end region, in which bore a clamp wheel 5 is mounted so as to be rotatable about the axis 3. It has a hexagonal recess 6 and, on its external, largely cylindrical, jacket surface, gearing 7 projecting outward. There engages with this gearing 7 a catch 8 which is positioned in a cut-out 9 in the power arm 2. Lastly, there is mounted in the reaction arm a hydraulic power cylinder consisting of a cylinder 10 and a piston 11. Transmission of power between this piston 11 and the power arm 2 is effected in accordance with the description given in DE-OS No. 34 07 126, the matter disclosed in which is stated expressly to be an integral part of this application.

As the figures show, the reaction arm 1 is made up of three easily dismountable parts: firstly, of a casing part 12 accommodating the hydraulic power cylinder, the connections, and other parts; and secondly, of two bearing boxes 13, 14, the upper end regions of which are form-fitted flush into a recess 15 in the casing part 12. The bearing boxes 13, 14 are connected to the casing part 12 by means of several screws 16, which are easy to loosen. The casing part 12 ends a great distance from the axis 3, in the embodiment under consideration on a line which extends parallel to the direction of operation of the hydraulic power cylinder and through the catch 8; hence it does not determine the untoleranced dimension of the nut-runner.

The two bearing boxes 13, 14 project relative to the casing part 12 in the direction of the axis 3, but they end before reaching a line which also extends parallel to the axis 17 of the hydraulic power cylinder and passes through the axis 3. Consequently, the bearing boxes 13, 14 do not extend into a half-space around the axis 3, which half-space is represented by arrows in FIG. 1. In other words, they do not determine the untoleranced dimension, and in particular not the radial untoleranced dimension of the nut-runner.

In the bearing boxes 13, 14, concentrically to the axis 3, a projection 19 is provided which with the bearing boxes 13, 14 mounted points inward and extends over approximately 170 degrees. It serves to guide the power arm 2 around the axis 3; this is discussed in detail in what follows.

The power arm consists of two half-arms 20, 21 of identical thickness (see FIG. 2) from each of which a part of cut-out 9 has been milled. Up to the curve of this cut-out, which is homologous, the two half-arms 20, 21 are non-overlapping. The two half-arms 20, 21 are connected to each other by suitable means, such as laterally by projections 22; other modes and places of connection are possible.

The power arm 2 made up of the two half-arms 20, 21 is more or less pear-shaped. It has a drive coupling 23, shown in FIGS. 1 and 2 as being positioned at the top. At least part of it is inside the cylinder 10, and it is inserted into a recess 24 adapted to it on both sides of the piston 11 (see FIG. 2). It is carried along in both directions of movement of the piston 11.

The catch 8 is located entirely inside the power arm 2, so that the latter may be replaced without the possibility of intervention into the mechanics of the catch 8. In contrast to the figure given in DE-OS No. 34 07 126, the catch 8 is in the engaged position shown in FIG. 1 exclusively with its face 25 on locking flank 26, without its front face coming to rest immediately on the edge of cut-out 9. As a result, even if the teeth of the catch 8 or the gearing 7 are worn, a precise engaged position is always achieved without being set by a fixed stop.

Figure 2:
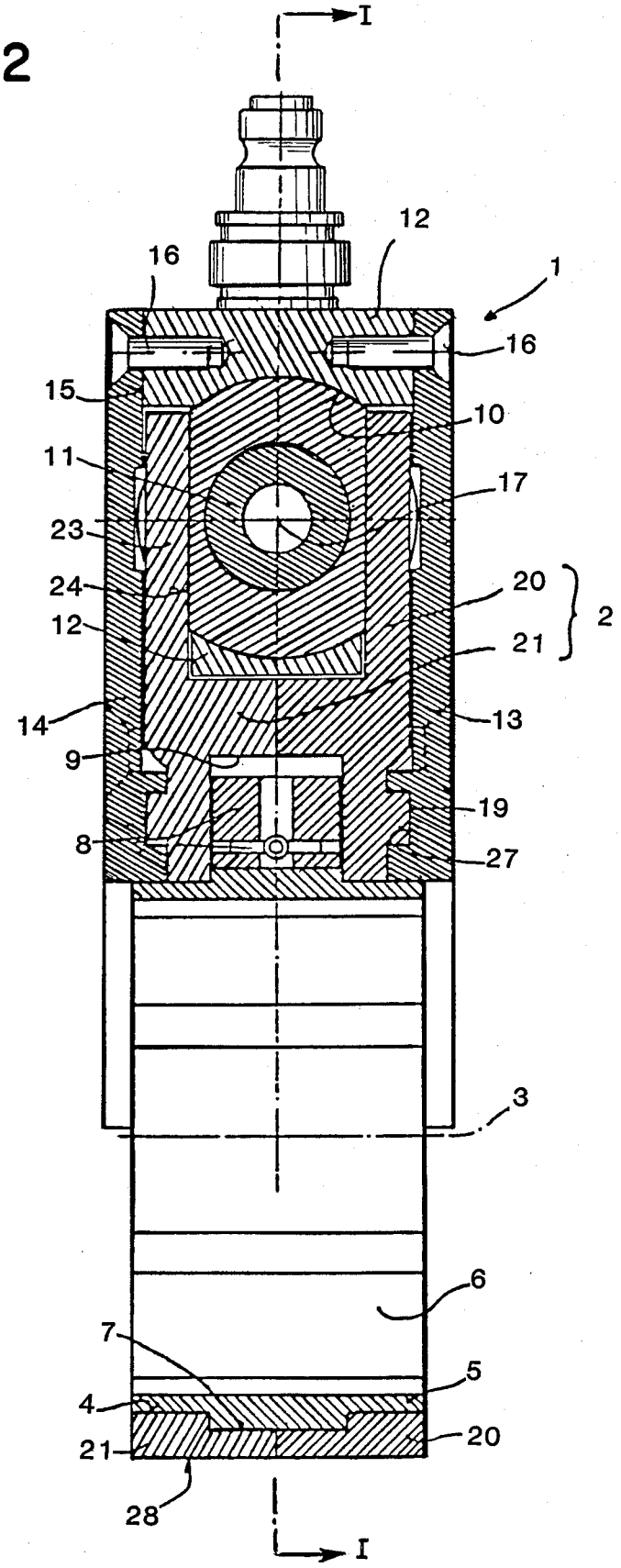
Figure 3:
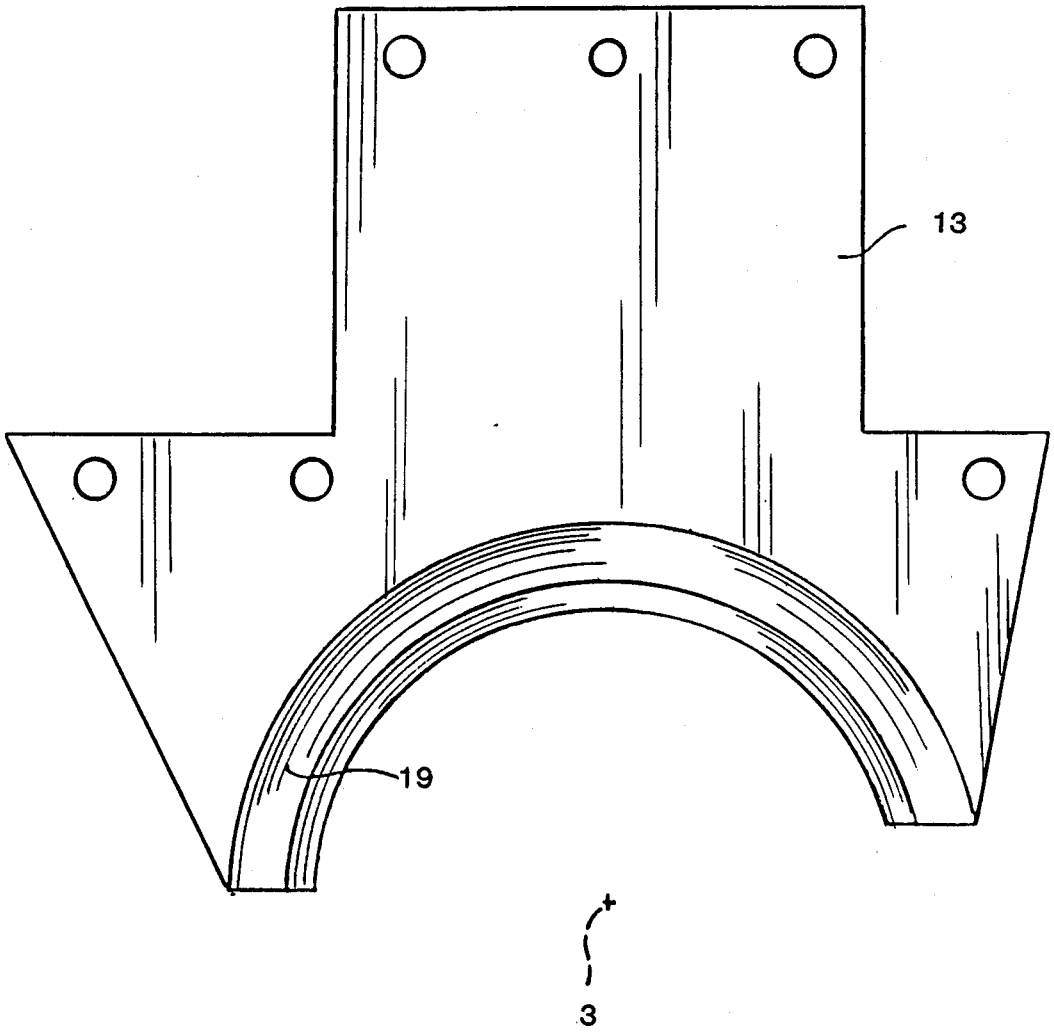

As FIG. 2 shows, a circular guide groove 27 positioned concentrically relative to the axis 3 and extending through approximately 90 degress is provided in the two half-arms 20, 21 of the power arm 2; projection 19 engages this guide groove tightly and largely without rattling, so that a curved guide is formed. This guide assumes the function of the circular guide surface of the reaction arm in the nut-runner as described in DE-OS No. 34 07 126. As the figures show, this guide is situated between the axis 3 and the second end regions of the arms 1, 2, shown in the Figures as being positioned at the top, so that this guide is not situated in the half-space designated by the arrows 18. The actual embodiment of the guide is in itself optional; the guide shown consisting of projection 19 and guide groove 27 is to be regarded essentially as a favorable exemplary embodiment. Kinematic reversal is possible; any other guides desired are also possible, so long as they are situated outside the lower halfspace (arrows 18) and do not interfere with passage through the hexagon 6. This free passage through the hexagon 6 is a characteristic advantageous for practical application of the nut-runner, one which has been achieved even with the state-of-the art nut-runners.

The nut-runner shown in the figures is equipped with a clamp wheel having the largest possible hexagonal recess. If it is desired to use the nut-runner for screws or nuts of smaller widths across, the clamp wheel 5 is not replaced. Instead, the complete, approximately pear-shaped, and fully enclosed unit is taken from the two half-arms 20, 21 forming the power arm 2, the clamp wheel 5, and the catch 8, together with fittings such as internal catch springs. To replace this unit with another one it suffices to unscrew the two bearing boxes 13, 14 from the casing element 12. The forked power arm 2 in its second (upper) end region can then be inserted into the recess 24, which is open at the bottom, through drive coupling 23. The path of the guide grooves 27 on the two half-arms 20, 21 of the power arm 2 persists and is independent of the particular unit used. The individual units differ as regards the size of the hexagonal recess 6 and—something of decisive importance for the untoleranced dimension—the exterior radius of the partly cylindrical face 28 in the first end region of the power arm 2.

A spindle holder with adjustable spindle may be mounted on the lefthand part of the casing element 12 shown in FIG. 1; the spindle is situated above or below the planes of the bearing boxes 13, 14. It is adjusted so that its forward end comes to rest and forms the support for the reaction arm 1.

We claim:

1. A nut-runner with a power arm and a reaction arm constructed preferably as a casing, said power arm being guided in an end region with respect to said reaction arm to permit said power arm to pivot with respect to said reaction arm about a common axis, with a clamp wheel having external teeth and with gearing mounted in a drilled hole in the first end region of the power arm so as to be rotatable about the axis, and with a catch mounted on the power arm interacting with this clamp wheel, said catch being in the engaged position when the power arm pivots in one direction, in which said catch engages with the teeth of the clamp wheel and slips over the teeth of the clamp wheel when the power arm pivots in the other direction, and with a hydraulic power cylinder consisting of a cylinder and a piston which acts between the two arms in the vicinity of their end regions, wherein the reaction arm partially encompasses the clamp wheel through a maximum angle of 180 degrees, and the arms engage by way of a circular guide positioned concentrically relative to the axis, extending over a maximum of 180 degrees, and consisting of a guide groove and a projection, said guide being positioned between the axis and the end region of the arms.

2. The nut-runner as claimed in claim 1, wherein the reaction arm consists of a casing element in which the hydraulic power cylinder is situated, and of two bearing boxes, which casing element and power cylinder are readily detachable, the bearing boxes being connected to the casing element so as to be readily detachable and each having a guide groove or a projection.

3. The nut-runner as claimed in claim 2, wherein the power arm is combined with the clamp wheel and the catch to form a readily replaceable unit and with the reaction arm to form a readily detachable unit, units being provided in which hexagonal recesses of the clamp wheel have different dimensions.

4. The nut-runner as claimed in one of claims 1 to 3, wherein the power arm is made up of two nonoverlapping half-arms.

5. The nut-runner as claimed in claim 4 wherein the power arm is designed to be substantially pear-shaped and is constructed in the form of a fork.

6. The nut-runner as claimed in claim 2 wherein a recess is provided on both sides in the casing element for a bearing box.

7. The nut-runner as claimed in claim 4 wherein the casing element does not extend to the outer circumference of the clamp wheel.

* * * * *